US009004969B2

(12) United States Patent
Ma

(10) Patent No.: US 9,004,969 B2
(45) Date of Patent: Apr. 14, 2015

(54) SPARK PLUG ELECTRODE AND SPARK PLUG MANUFACTURING METHOD

(71) Applicant: Federal-Mogul Ignition Company, Southfield, MI (US)

(72) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 261 days.

(21) Appl. No.: 13/659,297

(22) Filed: Oct. 24, 2012

(65) Prior Publication Data

US 2013/0099654 A1 Apr. 25, 2013

Related U.S. Application Data

(60) Provisional application No. 61/550,763, filed on Oct. 24, 2011.

(51) Int. Cl.
*H01T 21/02* (2006.01)
*H01T 13/39* (2006.01)

(52) U.S. Cl.
CPC ..... *H01T 13/39* (2013.01); *H01T 21/02* (2013.01)

(58) Field of Classification Search
USPC ..... 313/141; 445/7
See application file for complete search history.

(56) References Cited

U.S. PATENT DOCUMENTS

| | | | |
|---|---|---|---|
| 2,365,083 | A | 12/1944 | Jarrett |
| 2,391,456 | A | 12/1945 | Hensel |
| 2,391,457 | A | 12/1945 | Carlson |
| 2,862,844 | A | 12/1958 | Luedeman |
| 2,984,894 | A | 5/1961 | Hill |
| 3,356,882 | A | 12/1967 | Hallauer et al. |
| 3,496,622 | A | 2/1970 | Berghout et al. |
| 3,498,763 | A | 3/1970 | Kenton |
| 3,499,740 | A | 3/1970 | Rhys |
| 3,528,862 | A | 9/1970 | Jones et al. |
| 3,868,530 | A | 2/1975 | Eaton |
| 3,958,144 | A | 5/1976 | Franks |
| 4,048,705 | A | 9/1977 | Blanpain et al. |
| 4,093,887 | A | 6/1978 | Corbach et al. |
| 4,324,588 | A | 4/1982 | Zysk et al. |
| 4,699,600 | A | 10/1987 | Kondo |
| 4,725,254 | A | 2/1988 | Moore et al. |
| 4,742,265 | A | 5/1988 | Giachino et al. |
| 4,840,767 | A | 6/1989 | Branovich et al. |

(Continued)

FOREIGN PATENT DOCUMENTS

| | | |
|---|---|---|
| GB | 1168130 | 10/1969 |
| JP | 2001284013 | 10/2001 |

OTHER PUBLICATIONS

Written Opinion & International Search Report for PCT/US12/061660, Mar. 18, 2013, 9 pages.

*Primary Examiner* — Andrew Coughlin
(74) *Attorney, Agent, or Firm* — Reising Ethington P.C.

(57) ABSTRACT

A method of making a spark plug electrode includes several steps. One step includes providing an inner core of a ruthenium (Ru) based alloy or an iridium (Ir) based alloy. Another step includes providing an outer skin over a portion or more of the inner core in order to produce a core and skin assembly. The outer skin can be made of platinum (Pt), gold (Au), silver (Ag), nickel (Ni), or an alloy of one of these. Yet another step includes increasing the temperature of the core and skin assembly. And another step includes hot forming the core and skin assembly at the increased temperature.

20 Claims, 2 Drawing Sheets

(56) References Cited

U.S. PATENT DOCUMENTS

| | | | |
|---|---|---|---|
| 4,841,409 | A | 6/1989 | Kalwar |
| 5,101,135 | A | 3/1992 | Oshima |
| 5,500,304 | A | 3/1996 | Loffler et al. |
| 5,578,894 | A | 11/1996 | Oshima |
| 5,675,209 | A | 10/1997 | Hall, Jr. et al. |
| 5,779,842 | A | 7/1998 | Fawcett et al. |
| 5,793,793 | A | 8/1998 | Matsutani et al. |
| 5,866,973 | A | 2/1999 | Kagawa et al. |
| 5,869,921 | A | 2/1999 | Matsutani et al. |
| 5,973,443 | A | 10/1999 | Chang et al. |
| 5,977,695 | A | 11/1999 | Osamura et al. |
| 5,980,345 | A | 11/1999 | Chang et al. |
| 6,046,532 | A | 4/2000 | Matsutani et al. |
| 6,071,163 | A | 6/2000 | Chang et al. |
| 6,078,129 | A | 6/2000 | Gotou et al. |
| 6,093,071 | A | 7/2000 | Osamura et al. |
| 6,094,000 | A | 7/2000 | Osamura et al. |
| 6,262,522 | B1 | 7/2001 | Osamura et al. |
| 6,304,022 | B1 | 10/2001 | Matsutani |
| 6,326,719 | B1 | 12/2001 | Boehler et al. |
| 6,523,515 | B2 | 2/2003 | Kanao |
| 6,533,629 | B1 | 3/2003 | Boehler et al. |
| 6,624,576 | B1 | 9/2003 | Mittler |
| 6,750,430 | B2 | 6/2004 | Kelly |
| 6,846,214 | B1 | 1/2005 | Gotou et al. |
| 6,885,135 | B2 | 4/2005 | Kanao et al. |
| 7,223,144 | B2 | 5/2007 | Aisenbrey |
| 7,224,108 | B2 | 5/2007 | Aisenbrey |
| 7,352,120 | B2 | 4/2008 | Tinwell et al. |
| 7,569,979 | B2 | 8/2009 | Lykowski et al. |
| 7,872,405 | B2 | 1/2011 | Aisenbrey |
| 7,896,720 | B2 | 3/2011 | Suzuki et al. |
| 8,188,640 | B2 | 5/2012 | Suzuki et al. |
| 2001/0002000 | A1 | 5/2001 | Kumar et al. |
| 2002/0011768 | A1 | 1/2002 | Boehler et al. |
| 2002/0074920 | A1 | 6/2002 | Chiu et al. |
| 2002/0171346 | A1 | 11/2002 | Ulm et al. |
| 2003/0186075 | A1 | 10/2003 | Zhao et al. |
| 2006/0011490 | A1 | 1/2006 | Nguyen et al. |
| 2007/0236123 | A1* | 10/2007 | Lykowski et al. ..... 313/141 |
| 2011/0198983 | A1 | 8/2011 | Manhardt et al. |
| 2012/0194056 | A1 | 8/2012 | Ma |

* cited by examiner

SPARK PLUG ELECTRODE AND SPARK PLUG MANUFACTURING METHOD

REFERENCE TO RELATED APPLICATIONS

This application claims the benefit of U.S. Provisional Ser. No. 61/550,763 filed on Oct. 24, 2011, the entire contents of which are incorporated herein.

TECHNICAL FIELD

This invention generally relates to spark plugs and other ignition devices for internal combustion engines and, in particular, to electrodes used in spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures (e.g., 800° C.), high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, a method of making a spark plug electrode includes several steps. One step includes providing an inner core of a ruthenium (Ru) based alloy or an iridium (Ir) based alloy. Another step includes providing an outer skin over a portion or more of the inner core in order to produce a core and skin assembly. The outer skin may have platinum (Pt), gold (Au), silver (Ag), or nickel (Ni), or may have an alloy of Pt, an alloy of Au, an alloy of Ag, or an alloy of Ni. Yet another step includes increasing the temperature of the core and skin assembly to a temperature greater than approximately 1,000° C. And another step includes hot forming the core and skin assembly at the increased temperature into an elongated wire. Both of the inner core and the outer skin are elongated during the hot forming process.

According to another embodiment, a method of making a spark plug includes several steps. One step includes providing a center electrode, an insulator partly or more surrounding the center electrode, a shell partly or more surrounding the insulator, and a ground electrode attached to the shell. Another step includes providing an inner core by way of a powder metallurgical process. The inner core being of a ruthenium (Ru) based alloy or an iridium (Ir) based alloy. Yet another step includes providing an outer skin by way of an extrusion process in order to produce a hollow piece. The outer skin may have platinum (Pt), gold (Au), silver (Ag), or nickel (Ni), or may have an alloy of Pt, an alloy of Au, an alloy of Ag, or an alloy of Ni. And yet another step includes bringing the inner core and the hollow piece together in order to produce a core and skin assembly. Another step includes increasing the temperature of the core and skin assembly. Another step includes hot forming the core and skin assembly at the increased temperature into an elongated wire. Both of the inner core and the outer skin are elongated during the hot forming process. Another step includes cutting the elongated wire into one or more spark plug electrodes. And another step includes attaching the spark plug electrode to the center electrode, to the ground electrode, or attaching a first spark plug electrode to the center electrode and a second spark plug electrode to the ground electrode.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
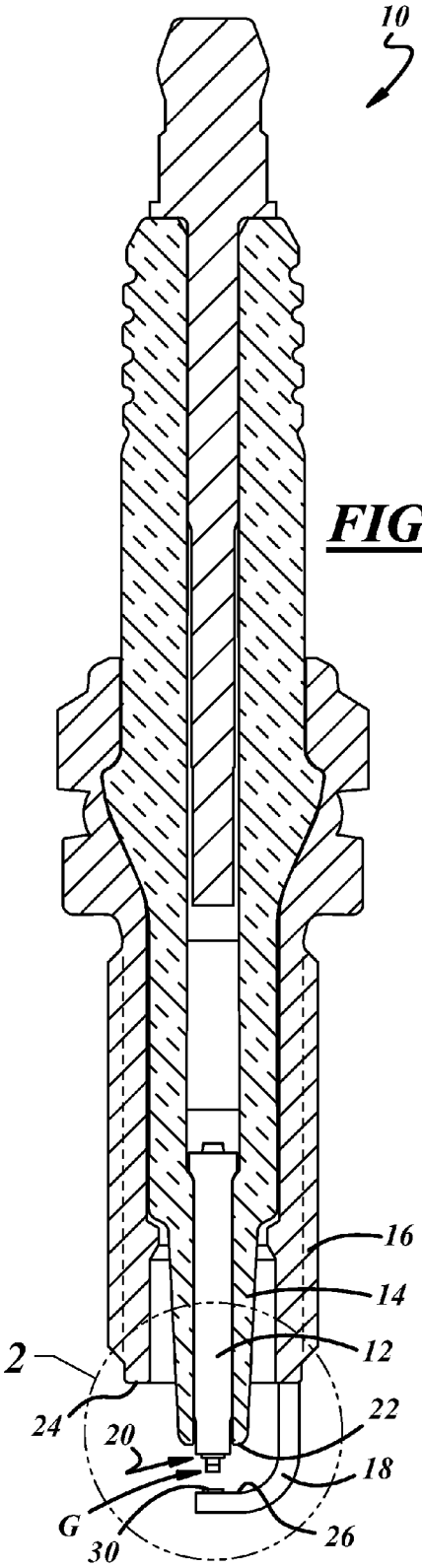
FIG. 1 is a sectional view of an illustrative spark plug that may use a spark plug electrode as described below.

The spark plug electrode described herein may be used in spark plugs and other ignition devices including industrial plugs, aviation igniters, glow plugs, or any other device that is used to ignite an air/fuel mixture in an engine. This includes, but is certainly not limited to, the illustrative spark plugs that are shown in the drawings and are described below. Furthermore, it should be appreciated that the spark plug electrode may be used as a firing tip that is attached to a center electrode, a ground electrode, or both. Other embodiments and applications of the spark plug electrode are also possible. All percentages provided herein are in terms of weight percentage (wt %), unless otherwise specified. And, as used herein, the terms axial, radial, and circumferential describe directions with respect to the generally elongated cylindrical shape of the spark plug of FIG. 1, unless otherwise specified.

Figure 2:
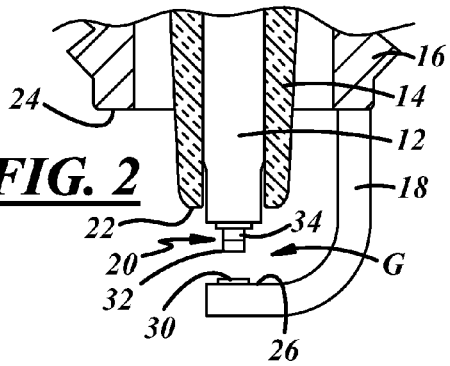
FIG. 2 is an enlarged view of a firing end of the spark plug from FIG. 1, wherein a center electrode has a firing tip in the form of a multi-piece rivet and a ground electrode has a firing tip in the form of a flat pad.

Referring to FIGS. 1 and 2, there is shown an illustrative spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, and that includes a second component 34 made from an intermediary material like a high-chromium nickel alloy. The first component 32 can be the spark plug electrode described below. In this particular embodiment, the first component 32 has a cylindrical shape and the second component 34 has a stepped and rivet shape that includes a diametrically-enlarged head section and a diametrically-reduced stem section. The first and second components may be attached to each other via a laser weld, a resistance weld, or another suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16 as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap. The firing tip 30 can be made from an erosion- and/or corrosion-resistant material.

Figure 3:
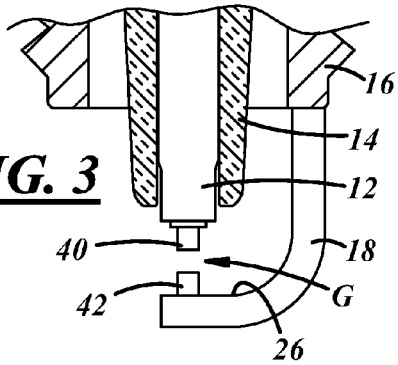
FIG. 3 is an enlarged view of a firing end of another illustrative spark plug that may use a spark plug electrode as described below, where a center electrode has a firing tip in the form of a single-piece rivet and a ground electrode has a firing tip in the form of a cylindrical tip.
Figure 4:
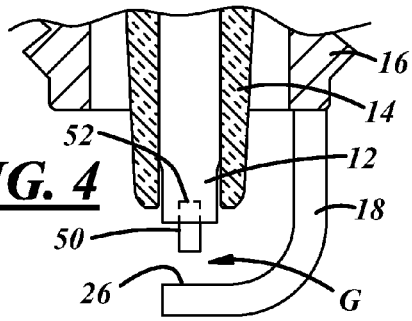
FIG. 4 is an enlarged view of a firing end of yet another illustrative spark plug that may use a spark plug electrode as described below, where a center electrode has a firing tip in the form of a cylindrical tip located in a recess and a ground electrode has no firing tip.
Figure 5:
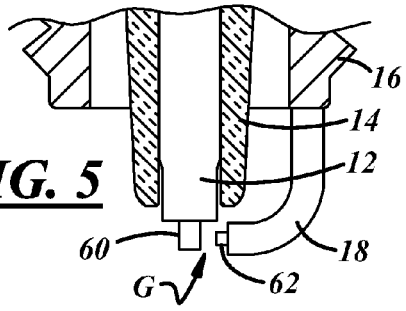
FIG. 5 is an enlarged view of a firing end of yet another illustrative spark plug that may use a spark plug electrode as described below, where a center electrode has a firing tip in the form of a cylindrical tip and a ground electrode has a firing tip in the form of a cylindrical tip that extends from a distal end of the ground electrode.

In this particular embodiment, the first component 32 of the center electrode firing tip 20 and/or the ground electrode firing tip 30 can be the spark plug electrode described herein; however, these are not the only applications for the presently described spark plug electrode. For instance, as shown in FIG. 3, the illustrative center electrode firing tip 40 and/or the ground electrode firing tip 42 can also constitute the spark plug electrode described herein. In this case, the center electrode firing tip 40 is a single-piece rivet and the ground electrode firing tip 42 is a single-piece cylinder that extends away from the side surface 26 of the ground electrode by a relatively increased distance compared to the flat pad of FIG. 2. The spark plug electrode of the present disclosure may also be used as the illustrative center electrode firing tip 50 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and the side surface 26 of the ground electrode 18, which also acts as a sparking surface. FIG. 5 shows yet another possible application for the spark plug electrode described herein, where a cylindrical firing tip 60 is attached to an axial end of the center electrode 12 and a cylindrical firing tip 62 is attached to an axial end with respect to the ground electrode 18 or a distal end of the ground electrode. Either or both of the cylindrical firing tips 60, 62 may constitute the presently described spark plug electrode. The ground electrode firing tip 62 forms a spark gap G with a side surface of the center electrode firing tip 60, and is thus a somewhat different firing end configuration than the other illustrative spark plugs shown in the drawings.

Again, it should be appreciated that the non-limiting spark plug embodiments described above are only examples of some of the potential uses for the spark plug electrode described herein, as it may be used or employed in any firing tip or other firing end component that is used in the ignition of an air/fuel mixture in an engine. For instance, the following components may use the present spark plug electrode: center and/or ground electrode firing tips that are in the shape of rivets, cylinders, bars, columns, wires, flat pads, disks, rings, sleeves, etc.; center and/or ground electrode firing tips that are attached directly to an electrode or indirectly to an electrode via one or more intermediate, intervening, or stress-releasing layers; center and/or ground electrode firing tips that are located within a recess of an electrode, or embedded into a surface of an electrode; or spark plugs having multiple ground electrodes, multiple spark gaps, or semi-creeping type spark gaps. These are but a few examples of the possible applications of the spark plug electrode, others exist as well.

Figure 6:
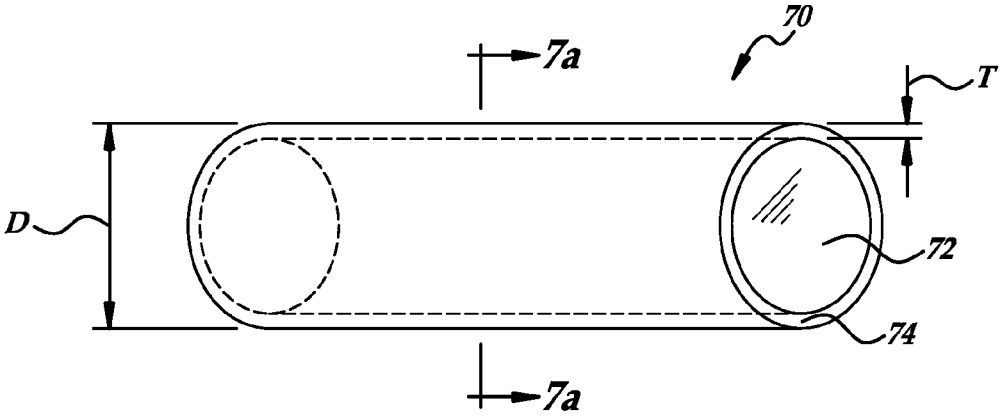
FIG. 6 is a perspective view of an illustrative spark plug electrode that may be used in the spark plugs of FIGS. 1-5.
Figure 7A:
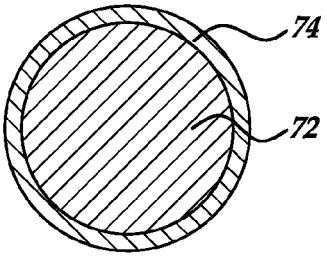
FIGS. 7*a*-7*f* are sectional views of different embodiments of the spark plug electrode of FIG. 6

Referring now to FIGS. 6 and 7*a*, a spark plug electrode 70 is constructed of two distinct portions composed of different materials—an inner core 72 and an outer skin 74. The inner core 72 can be made of an alloy of ruthenium (Ru) or an alloy of iridium (Ir). While these materials exhibit certain desirable attributes during use and performance, they can exhibit some undesirable attributes during the formation and fabrication processes when making a spark plug electrode. For example, when formed, such as by extruding, at increased temperatures alone and without the outer skin, the ruthenium and iridium materials can experience excessive oxidation causing weight loss, and can break and fracture. In some cases, this is due to the relatively brittle property of the material and hinders the ability to metalwork the material into a useful end product for spark plugs. The outer skin 74, on the other hand, can be made of a material with comparatively greater ductility. The outer skin 74 can be made of platinum (Pt), gold (Au), silver (Ag), or nickel (Ni), or can be made of an alloy of platinum, an alloy of gold, an alloy of silver, or an alloy of nickel. When assembled together, the outer skin 74 protects and shields the inner core 72 during the formation and fabrication process at increased temperature, and can limit or altogether prevent excessive oxidation and breakage and fracture of the inner core. Furthermore, depending on the exact materials used and attachment method, the outer skin 74 can facilitate attachment of the spark plug electrode 70 to the center electrode 12 or to the ground electrode 18 by providing a material more chemically and materially compatible for welding to the center and ground electrodes than the material of the inner core 72. And, during use of the spark plug electrode 70 in an engine, the outer skin 74 can improve the spark plug electrode's resistance to oxidation, corrosion, and erosion because less surface area of the inner core 72 is exposed during sparking action, and the outer skin 74 can improve the spark plug electrode's thermal conductivity.

The inner core 72 is composed of a ruthenium based alloy or an iridium based alloy. The term "ruthenium based," as used herein, broadly includes a material where ruthenium is the single largest constituent on a weight percentage basis; and, similarly, the term "iridium based," as used herein, broadly includes a material where iridium is the single largest constituent on a weight percentage basis. In a ruthenium based material, this may include materials having greater than 50% ruthenium, as well as materials having less than 50% ruthenium so long as the ruthenium is the single largest constituent. In an iridium based material, likewise, this may include materials having greater than 50% iridium, as well as materials having less than 50% iridium so long as the iridium is the single largest constituent. Ruthenium based alloys have a relatively high melting point (approximately 2334° C.) compared to some other precious metals, which can improve the erosion and wear resistance of the inner core 72 during its use in an engine. Ruthenium based alloys also exhibit oxidation resistance to a degree desirable in some applications including engines.

Some non-limiting examples of potential compositions for the ruthenium based alloys of the inner core 72 include (the following compositions are given in weight percentage, and the Ru constitutes the balance): Ru–45Rh; Ru–40Rh; Ru–35Rh; Ru–30Rh; Ru–25Rh; Ru–20Rh; Ru–15Rh; Ru–10Rh; Ru–5Rh; Ru–2Rh; Ru–1Rh; Ru–45Pt; Ru–40Pt; Ru–35Pt; Ru–30Pt; Ru–25Pt; Ru–20Pt; Ru–15Pt; Ru–10Pt; Ru–5Pt; Ru–2Pt; Ru–1Pt; Ru–25Pt–25Rh; Ru–20Pt–20Rh; Ru–15Pt–15Rh; Ru–10Pt–10Rh; Ru–5Pt–5Rh; and Ru–2Pt–2Rh. Furthermore, the ruthenium based alloys of the inner core 72 can also include the following alloy systems: Ru—Rh—Ir; Ru—Rh—Pd; Ru—Rh—Pt; Ru—Pt—Rh; Ru—Rh—Au; Ru—Pt—Ir; Ru—Pt—Pd; Ru—Pt—Au; Ru—Pd—Rh; Ru—Pd—Pt; Ru—Pd—Ir; Ru—Ir—Rh; Ru—Ir—Pt; Ru—Ir—Pd; Ru—Rh—Pt—Ir; Ru—Rh—Pt—Pd; Ru—Rh—Pt—Au; Ru—Pt—Rh—Ir; and Ru—Pt—Rh—Pd. Similarly, some non-limiting examples of potential compositions for the iridium based alloys of the inner core 72 include (the following compositions are given in weight percentage, and the Ir constitutes the balance): Ir–45Rh; Ir–40Rh; Ir–30Rh; Ir–20Rh; Ir–10Rh; Ir–5Rh; Ir–2Rh; Ir–45Pt; Ir–40Pt; Ir–30Pt; Ir–20Pt; Ir–10Pt; Ir–5Pt; Ir–2Pt; Ir–25Pt–25Rh; Ir–20Pt–20Rh; Ir–15Pt–15Rh; Ir–10Pt–10Rh; Ir–5Pt–5Rh; and Ir–2Pt–2Rh. Furthermore, the iridium based alloys of the inner core 72 can also include the following alloy systems: Ir—Rh—Ru; Ir—Rh—Pd; Ir—Rh—Au; Ir—Pt—Ru; Ir—Pt—Pd; Ir—Pt—Au; Ir—Rh—Pt—Ru; Ir—Rh—Pt—Pd; and Ir—Rh—Pt—Au.

The ruthenium based alloy or the iridium based alloy of the inner core 72 can include rhenium (Re) from about 0.1-10 wt %. These materials are more ductile than other ruthenium and iridium based materials without rhenium, yet still maintain an acceptable level of erosion and corrosion resistance for most applications. The ductility improvement is at least partially attributable to the added rhenium and to the particular manufacturing process used like the powder metallurgy sintering and post-sintering extrusion processes described below. In one embodiment, the ruthenium based alloy of the inner core 72 includes rhenium in the above weight percentages plus one or more precious metals that can be selected from rhodium (Rh), platinum, iridium, palladium (Pd), gold, and combinations thereof. In this embodiment, the ruthenium based alloy of the inner core 72 can further include one or more refractory metals, rare earth metals, other constituents, and combinations thereof. In one embodiment, the iridium based alloy of the inner core 72 includes rhenium in the above weight percentages plus one or more precious metals that can be selected from rhodium, platinum, ruthenium, palladium, gold, and combinations thereof. In this embodiment, the iridium based alloy of the inner core 72 can further include one or more refractory metals, rare earth metals, other constituents, and combinations thereof. The refractory metals of the ruthenium based alloy and iridium based alloy embodiments can be selected from tungsten (W), rhenium (already mentioned above), tantalum (Ta), molybdenum (Mo), niobium (Nb), and combinations thereof. The rare earth metals of the ruthenium based alloy and iridium based alloy embodiments can be selected from yttrium (Y), hafnium (Hf), scandium (Sc), zirconium (Zr), and lanthanum (La). A periodic table published by the International Union of Pure and Applied Chemistry (IUPAC) is provided in Addendum A (hereafter the "attached periodic table") and is to serve as a reference for this patent application.

According to one embodiment, the alloy includes either iridium or ruthenium from about 90 wt % to 99.9 wt % and rhenium from about 0.1 wt % to 10 wt %. Some non-limiting examples of potential compositions for such alloys include (in the following compositions, the Ir or Ru constitutes the balance): Ir–10Re; Ir–5Re; Ir–2Re; Ir–1Re; Ir–0.5Re; Ir–0.1Re; Ru–10Re; Ru–5Re; Ru–2Re; Ru–1Re; Ru–0.5Re; and Ru–0.1Re. Some exemplary binary alloy compositions that may be particularly useful with spark plug electrodes include Ir–(0.1–5)Re and Ru–(0.1–5)Re.

According to another embodiment, the alloy includes either iridium or ruthenium from about 50 wt % to 99.9 wt %, a single precious metal (other than the Ir or Ru just mentioned) from about 0.1 wt % to 49.9 wt %, and rhenium from about 0.1 wt % to 5 wt %. Some examples of suitable alloy systems having only one precious metal added to the iridium or ruthenium based alloy include: Ir—Rh—Re; Ir—Pt—Re; Ir—Ru—Re; Ir—Pd—Re; Ir—Au—Re; Ru—Rh—Re; Ru—Pt—Re; Ru—Ir—Re; Ru—Pd—Re; and Ru—Au—Re alloys, where the iridium or ruthenium is still the largest single constituent. Some non-limiting examples of potential compositions for such alloys include (in the following compositions, the Re content is between about 0.1 wt % and 5 wt % and the Ir or Ru constitutes the balance): Ir–45Rh—Re; Ir–40Rh—Re; Ir–35Rh—Re; Ir–30Rh—Re; Ir–25Rh—Re; Ir–20Rh—Re; Ir–15Rh—Re; Ir–10Rh—Re; Ir–5Rh—Re; Ir–2Rh—Re; Ir–1Rh—Re; Ir–0.5Rh—Re; Ir–0.1Rh—Re; Ir–45Pt—Re; Ir–40Pt—Re; Ir–35Pt—Re; Ir–30Pt—Re; Ir–25Pt—Re; Ir–20Pt—Re; Ir–15Pt—Re; Ir–10Pt—Re; Ir–5Pt—Re; Ir–2Pt—Re; Ir–1Pt—Re; Ir–0.5Pt—Re; Ir–0.1Pt—Re; Ir–45Ru—Re; Ir–40Ru—Re; Ir–35Ru—Re; Ir–30Ru—Re; Ir–25Ru—Re; Ir–20Ru—Re; Ir–15Ru—Re; Ir–10Ru—Re; Ir–5Ru—Re; Ir–2Ru—Re; Ir–1Ru—Re; Ir–0.5Ru—Re; Ir–0.1Ru—Re; Ir–45Pd—Re; Ir–40Pd—Re; Ir–35Pd—Re; Ir–30Pd—Re; Ir–25Pd—Re; Ir–20Pd—Re; Ir–15Pd—Re; Ir–10Pd—Re; Ir–5Pd—Re; Ir–2Pd—Re; Ir–1Pd—Re; Ir–0.5Pd—Re; Ir–0.1Pd—Re; Ir–45Au—Re; Ir–40Au—Re; Ir–35Au—Re; Ir–30Au—Re; Ir–25Au—Re; Ir–20Au—Re; Ir–15Au—Re; Ir–10Au—Re; Ir–5Au—Re; Ir–2Au—Re; Ir–1Au—Re; Ir–0.5Au—Re; Ir–0.1Au—Re; Ru–45Rh—Re; Ru–40Rh—Re; Ru–35Rh—Re; Ru–30Rh—Re; Ru–25Rh—Re; Ru–20Rh—Re; Ru–15Rh—Re; Ru–10Rh—Re; Ru–5Rh—Re; Ru–2Rh—Re; Ru–1Rh—Re; Ru–0.5Rh—Re; Ru–0.1Rh—Re; Ru–45Pt—Re; Ru–40Pt—Re; Ru–35Pt—Re; Ru–30Pt—Re; Ru–25Pt—Re; Ru–20Pt—Re; Ru–15Pt—Re; Ru–10Pt—Re; Ru–5Pt—Re; Ru–2Pt—Re; Ru–1Pt—Re; Ru–0.5Pt—Re; Ru–0.1Pt—Re; Ru–45Ir—Re; Ru–40Ir—Re; Ru–35Ir—Re; Ru–30Ir—Re; Ru–25Ir—Re; Ru–20Ir—Re; Ru–15Ir—Re; Ru–10Ir—Re; Ru–5Ir—Re; Ru–2Ir—Re; Ru–1Ir—Re; Ru–0.5Ir—Re; Ru–0.1Ir—Re; Ru–45Pd—Re; Ru–40Pd—Re; Ru–35Pd—Re; Ru–30Pd—Re; Ru–25Pd—Re; Ru–20Pd—Re; Ru–15Pd—Re; Ru–10Pd—Re; Ru–5Pd—Re; Ru–2Pd—Re; Ru–1Pd—Re; Ru–0.5Pd—Re; Ru–0.1Pd—Re; Ru–45Au—Re; Ru–40Au—Re; Ru–35Au—Re; Ru–30Au—Re; Ru–25Au—Re; Ru–20Au—Re; Ru–15Au—Re; Ru–10Au—Re; Ru–5Au—Re; Ru–2Au—Re; Ru–1Au—Re; Ru–0.5Au—Re; and Ru–0.1Au—Re. Some exemplary ternary alloy compositions that may be particularly useful for the inner core 72 include Ir–(1–10)Rh–(0.1–2)Re and Ru–(1–10)Rh–(0.1–2)Re.

According to another embodiment, the alloy includes iridium or ruthenium from about 35 wt % to 99.9 wt %, a first precious metal from about 0.1 wt % to 49.9 wt %, a second precious metal from about 0.1 wt % to 49.9 wt %, and rhenium from about 0.1 wt % to 5 wt %. Some examples of suitable alloy systems having two precious metals added to the iridium or ruthenium based alloy include: Ir—Rh—Pt—Re; Ir—Rh—Ru—Re; Ir—Rh—Pd—Re; Ir—Rh—Au—Re; Ir—Pt—Rh—Re; Ir—Pt—Ru—Re; Ir—Pt—Pd—Re; Ir—Pt—Au—Re; Ir—Ru—Rh—Re; Ir—Ru—Pt—Re; Ir—Ru—Pd—Re; Ir—Ru—Au—Re; Ir—Au—Rh—Re; Ir—Au—Pt—Re; Ir—Au—Ru—Re; Ir—Au—Pd—Re; Ru—Rh—Pt—Re; Ru—Rh—Ir—Re; Ru—Rh—Pd—Re; Ru—Rh—Au—Re; Ru—Pt—Rh—Re; Ru—Pt—Ir—Re; Ru—Pt—Pd—Re; Ru—Pt—Au—Re; Ru—Ir—Rh—Re; Ru—Ir—Pt—Re; Ru—Ir—Pd—Re; Ru—Ir—Au—Re; Ru—Au—Rh—Re; Ru—Au—Pt—Re; Ru—Au—Ir—Re; and Ru—Au—Pd—Re alloys, where the iridium or ruthenium is still the largest single constituent. Some non-limiting examples of potential compositions for such alloys include (in the following compositions, the Re content is between about 0.1 wt % and 5 wt % and the Ir or Ru constitutes the balance): Ir–30Rh–30Pt—Re; Ir–25Rh–25Pt—Re; Ir–20Rh–20Pt—Re; Ir–15Rh–15Pt—Re; Ir–10Rh–10Pt—Re; Ir–5Rh–5Pt—Re; Ir–2Rh–2Pt—Re; Ru–30Rh–30Pt—Re; Ru–25Rh–25Pt—Re; Ru–20Rh–20Pt—Re; Ru–15Rh–15Pt—Re; Ru–10Rh–10Pt—Re; Ru–5Rh–5Pt—Re; and Ru–2Rh–2Pt—Re. Some exemplary compositions that may be particularly useful for the inner core 72 include Ir—Rh—Ru—Re and Ru—Rh—Re where the rhodium content is from about 1 wt % to 10 wt %, the rhenium content is from about 0.1 wt % to 2 wt %, and the iridium/ruthenium constitutes the balance. Some exemplary quaternary alloy compositions that may be particularly useful for the inner core 72 include Ir–(1–10)Rh–(0.5–5)Ru–(0.1–2)Re and Ru–(1–10)Rh–(0.5–5)Ir–(0.1–2)Re.

According to another embodiment, the alloy includes iridium or ruthenium from about 35 wt % to 99.9 wt %, a first precious metal from about 0.1 wt % to 49.9 wt %, a second precious metal from about 0.1 wt % to 49.9 wt %, a third precious metal from about 0.1 wt % to 49.9 wt %, and rhenium from about 0.1 wt % to 5 wt %. Some examples of suitable materials having three precious metals added to the iridium or ruthenium based alloy include: Ir—Rh—Pt—Ru—Re; Ir—Rh—Pt—Pd—Re; Ir—Rh—Pt—Au—Re; Ru—Rh—Pt—Ir—Re; Ru—Rh—Pt—Pd—Re; and Ru—Rh—Pt—Au—Re alloys, where the iridium or ruthenium is still the largest single constituent. An exemplary composition of the alloy that may be particularly useful for the inner core 72 is the ruthenium based material Ru–(1–10)Rh–(0.5–5)Ir–(0.1–2)Re–(0.05–0.1)Y.

In yet another embodiment, the ruthenium based alloy includes ruthenium from about 35 wt % to about 99.9 wt %, inclusive, a first precious metal from about 0.1 wt % to about 49.9 wt %, inclusive, and a second precious metal from about 0.1 wt % to about 49.9 wt %, inclusive, where the ruthenium is the single largest constituent of the alloy. Ruthenium based alloys that include rhodium and platinum, where the combined amount of rhodium and platinum is between 1%-65%, inclusive, may be particularly useful for certain spark plug applications. Examples of suitable alloy compositions that fall within this embodiment include those compositions having ruthenium plus two or more precious metals selected from the group of rhodium, platinum, palladium, and/or iridium. Such compositions may include the following non-limiting examples: Ru–30Rh–30Pt; Ru–35Rh–25Pt; Ru–35Pt–25Rh; Ru–25Rh–25Pt; Ru–30Rh–20Pt; Ru–30Pt–20Rh; Ru–20Rh–20Pt; Ru–25Rh–15Pt; Ru–25Pt–15Rh; Ru–15Rh–15Pt; Ru–20Rh–10Pt; Ru–20Pt–10Rh; Ru–10Rh–10Pt; Ru–15Rh–5Pt; Ru–15Pt–5Rh; Ru–5Rh–5Pt; Ru–10Rh–1Pt; Ru–10Pt–1Rh; Ru–2Rh–2Pt; Ru–1Rh–1Pt; Ru–30Rh–20Ir; Ru–30Pt–20Ir; Ru–30Ir–20Rh; Ru–30Ir–20Pt; Ru–40Rh–10Pt; Ru–40Rh–10Ir; Ru–40Pt–10Rh; Ru–40Pt–10Ir; Ru–40Ir–10Rh; and Ru–40Ir–10Pt; other examples are certainly possible.

According to another embodiment, the ruthenium based alloy includes ruthenium from about 35 wt % to about 99.9 wt %, inclusive, one or more precious metals from about 0.1 wt % to about 49.9 wt %, inclusive, and a refractory metal from about 0.1 wt % to about 5 wt %, inclusive, where the ruthenium is the single largest constituent of the electrode material. Tungsten, molybdenum, niobium, tantalum and/or rhenium, for example, may be a suitable refractory metal for the alloy. It has been found that particles of refractory metals can exhibit a pinning effect at the grain boundaries of the material and can help prevent potential grain growth in ruthenium based alloys subject to powder metallurgy processes; this can facilitate hot forming processes such as hot extrusion. Furthermore, refractory metals may help lower the overall cost of the component. In one embodiment, a refractory metal constitutes the greatest constituent in the electrode material after ruthenium and one or more precious metals, and is present in an amount that is greater than or equal to 0.1 wt % and is less than or equal to 5 wt %. Examples of suitable alloy compositions that fall within this embodiment include Ru—Rh—W; Ru—Rh—Mo; Ru—Rh—Nb; Ru—Rh—Ta; Ru—Rh—Re; Ru—Pt—W; Ru—Pt—Mo; Ru—Pt—Nb; Ru—Pt—Ta; Ru—Pt—Re; Ru—Rh—Pt—W; Ru—Rh—Pt—Mo; Ru—Rh—Pt—Nb; Ru—Rh—Pt—Ta; Ru—Rh—Pt—Re; Ru—Pt—Rh—W; Ru—Pt—Rh—Mo; Ru—Pt—Rh—Nb; Ru—Pt—Rh—Ta; Ru—Pt—Rh—Re; etc. Numerous compositional combinations of this embodiment are possible.

Depending on the particular embodiment and the particular properties that are desired, the amount of ruthenium in the ruthenium based alloy may be: greater than or equal to 35 wt %, 50 wt %, 65 wt % or 80 wt %; less than or equal to 99.9%, 95 wt %, 90 wt % or 85 wt %; or between 35-99.9%, 50-99.9 wt %, 65-99.9 wt %, or 80-99.9 wt %, to cite a few examples. Likewise, the amount of rhodium in the ruthenium based alloy may be: greater than or equal to 0.1 wt %, 2 wt %, 10 wt %, or 20 wt %; less than or equal to 49.9 wt %, 40 wt %, 20 wt %, or 10 wt %; or between 0.1-49.9 wt %, 0.1-40 wt %, 0.1-20 wt %, or 0.1-10 wt %. The amount of platinum in the ruthenium based alloy may be: greater than or equal to 0.0 wt %, 2 wt %, 10 wt %, or 20 wt %; less than or equal to 49.9 wt %, 40 wt %, 20 wt %, or 10 wt %; or between 0.1-49.9 wt %, 0.1-40 wt %, 0.1-20 wt %, or 0.1-10 wt %. The amount of rhodium and platinum combined or together in the ruthenium based alloy may be: greater than or equal to 1 wt %, 5 wt %, 10 wt %, or 20 wt %; less than or equal to 65 wt %, 50 wt %, 35 wt %, or 20 wt %; or between 1-65 wt %, 1-50 wt %, 1-35 wt %, or 1-20 wt %. The amount of a refractory metal—i.e., a refractory metal other than ruthenium—in the ruthenium based alloy may be: equal to 0.1 wt %, 1 wt %, 2 wt %, or 5 wt %; less than or equal to 5 wt %; or between 0.1-5 wt %. The same percentage ranges apply to hafnium, nickel, and/or gold, as introduced below. The preceding amounts, percentages, limits, ranges, etc. are only provided as examples of some of the different alloy embodiments that are possible, and are not meant to limit the scope of the alloy.

Other constituents, such as hafnium, nickel, and/or gold, may also be added to the ruthenium based alloy. In one instance, a suitable alloy composition includes some combination of ruthenium, rhodium, platinum, and hafnium, nickel, and/or gold, such as Ru—Rh—Hf; Ru—Rh—Ni; Ru—Rh—Au; Ru—Pt—Hf; Ru—Pt—Ni; Ru—Pt—Au; Ru—Rh—Pt—Hf; Ru—Rh—Pt—Ni; Ru—Rh—Pt—Au; Ru—Pt—Rh—Hf; Ru—Pt—Rh—Ni; Ru—Pt—Rh—Au; Ru—Rh—Pt—Hf—Ni; Ru—Pt—Rh—Hf—Ni; Ru—Rh—Pt—Ni—Hf; Ru—Pt—Rh—Ni—Hf; etc.

In some embodiments, while still being composed of a ruthenium based alloy or an iridium based alloy, the inner core 72 can be made of an alloy material that is a metal composite and includes a particulate component embedded or dispersed within a matrix component. Accordingly, the metal composite has a multi-phase microstructure where, on a macro-scale, the matrix component differs in composition and/or form from the particulate component. The individual components or phases of the exemplary metal composite do not completely dissolve or merge into one another, even though they may interact with one another, and therefore may exhibit a boundary or junction between them.

The matrix component—also referred to as a matrix phase or binder—is the portion of the alloy material into which the particulate component is embedded or dispersed. The matrix component may include one or more precious metals, such as platinum, palladium, gold, and/or silver, but according to an exemplary embodiment it includes a platinum-based material. The term "platinum-based material," as used herein, broadly includes any material where platinum is the single largest constituent on a weight % basis. This may include materials having greater than 50% platinum, as well as those having less than 50% platinum so long as the platinum is the single largest constituent. It is possible for the matrix component to include a pure precious metal (e.g., pure platinum or pure palladium), a binary-, ternary- or quaternary-alloy including one or more precious metals, or some other suitable material. According to an embodiment, the matrix component makes up about 2-20 wt % of the overall metal composite and includes a pure platinum material with grains that have a grain size that ranges from about 1 μm to 20 μm, inclusive (i.e., after the alloy material has been extruded). The size of the grains can be determined by using a suitable measurement method, such as the Planimetric method outlined in ASTM E112. This is, of course, only one possibility for the matrix component, as other embodiments are certainly possible. For example, the matrix material may include one or more precious metals, refractory metals, and/or rare earth metals, each of which may be selected to impart certain properties or attributes to the alloy material.

The particulate component—also referred to as a particulate phase or reinforcement—is the portion of the alloy material that is embedded or dispersed in the matrix component. The particulate component may include a ruthenium based material that includes one or more precious metals, like rhodium, platinum, iridium, or combinations thereof. The particulate component disclosed herein may include ruthenium plus one or more additional constituents like precious metals, refractory metals and/or rare earth metals. According to an embodiment, the particulate component makes up about 80-98 wt % of the overall metal composite, it is a hard and brittle particulate that includes a ruthenium based material having rhodium, platinum, iridium, or combinations thereof (i.e., a Ru—Rh; Ru—Pt; Ru—Ir; Ru—Rh—Pt; Ru—Rh—Ir; Ru—Pt—Rh; Ru—Pt—Ir; Ru—Ir—Rh; or a Ru—Ir—Pt alloy), and it has grains that range in size from about 1 μm to 20 μm, inclusive. One ruthenium based material composition that may be particularly useful is Ru—Rh, where the rhodium is from about 0.1 to 15 wt % and the ruthenium constitutes the balance. This is, of course, only one possibility for the particulate component, as other embodiments are certainly possible. It is also possible for the particulate component to include one or more refractory metals and/or rare earth metals, or for the particulate material to be made of pure ruthenium.

In the metal composite embodiment of the inner core 72, some non-limiting examples of precious metals that are suitable for use in the matrix component include platinum, palladium, gold, and/or silver, while non-limiting examples of suitable precious metals for the particulate component include rhodium, platinum, palladium, iridium, and/or gold. In an embodiment of the matrix component, the matrix component includes a pure precious metal, such as pure platinum or pure palladium. In an embodiment of the particulate component, a precious metal is the second greatest or largest constituent of the particulate component on a wt % basis, after ruthenium, and is present in the particulate component from about 0.1 wt % to about 49.9 wt %, inclusive. Some examples of such a particulate material include binary alloys such as Ru—Rh; Ru—Pt; and Ru—Ir. It is also possible for the particulate component to include more than one precious metal and, in at least one embodiment, the particulate component includes ruthenium plus first and second precious metals. Each of the first and second precious metals may be present in the particulate component from about 0.1 wt % to about 49.9 wt %, inclusive, and the combined amount of the first and second precious metals together is equal to or less than about 65 wt %, inclusive. Some examples of such a particulate material include the following ternary and quaternary alloys: Ru—Rh—Pt; Ru—Pt—Rh; Ru—Rh—Ir; Ru—Pt—Ir; Ru—Rh—Pd; Ru—Pt—Pd; Ru—Rh—Au; Ru—Pt—Au; Ru—Rh—Pt—Ir; Ru—Rh—Pt—Pd; and Ru—Rh—Pt—Au alloys. In each of these embodiments, ruthenium is still preferably the largest single constituent. One or more additional elements, compounds, and/or other constituents may be added to the matrix and/or particulate materials described above, including refractory metals and/or rare earth metals.

In the metal composite embodiment of the inner core 72, some non-limiting examples of refractory metals that are suitable for use in the alloy material include tungsten, rhenium, tantalum, molybdenum, and niobium; nickel may be added to the alloy material as well. In an embodiment, a refractory metal is the third or fourth greatest or largest constituent of the particulate component on a wt % basis, after ruthenium and one or more precious metals, and is present in the particulate component from about 0.1 wt % to about 10 wt %, inclusive.

In the metal composite embodiment of the inner core 72, some non-limiting examples of rare earth metals that are suitable for use in the alloy material include yttrium, hafnium, scandium, zirconium, and lanthanum. In an embodiment, a rare earth metal is the fourth or fifth greatest or largest constituent of the particulate component on a weight percentage basis—after ruthenium, one or more precious metals, and one or more refractory metals—and is present in the particulate component from about 0.01 wt % to 0.1 wt %, inclusive. The rare earth metals may form a protective oxide layer (e.g., $Y_2O_3$, $ZrO_2$, etc.) in the alloy material that is beneficial in terms of material performance.

In an embodiment of the matrix component, the matrix component includes pure platinum, pure palladium, or some other pure precious metal. In another embodiment, the matrix component includes a platinum-based material that has platinum from about 50 wt % to about 99.9 wt %, inclusive, and another precious metal, a refractory metal or a rare earth metal from about 0.1 wt % to about 49.9 wt %, inclusive, where the platinum is the single largest constituent of the matrix material on a wt % basis.

In an embodiment of the particulate component, the particulate component includes a ruthenium based material with ruthenium from about 50 wt % to about 99.9 wt %, inclusive, and a single precious metal from about 0.1 wt % to about 49.9 wt %, inclusive, where the ruthenium is the single largest constituent of the particulate material on a wt % basis. Rhodium, platinum, or iridium, for example, may be the precious metal referred to above. Examples of suitable particulate material compositions that fall within this embodiment include those compositions having ruthenium plus one precious metal selected from the group of rhodium, platinum, or iridium, such as Ru—Rh, Ru—Pt or Ru—Ir. Such compositions may include the following non-limiting examples: Ru–45Rh; Ru–40Rh; Ru–35Rh; Ru–30Rh; Ru–25Rh; Ru–20Rh; Ru–15Rh; Ru–10Rh; Ru–5Rh; Ru–2Rh; Ru–1Rh; Ru–0.5Rh; Ru–0.1Rh; Ru–45Pt; Ru–40Pt; Ru–35Pt; Ru–30Pt; Ru–25Pt; Ru–20Pt; Ru–15Pt; Ru–10Pt; Ru–5Pt; Ru–2Pt; Ru–1Pt; Ru–0.5Pt; Ru–0.1Pt; Ru–45Ir; Ru–40Ir; Ru–35Ir; Ru–30Ir; Ru–25Ir; Ru–20Ir; Ru–15Ir; Ru–10Ir; Ru–5Ir; Ru–2Ir; Ru–1Ir; Ru–0.5Ir; Ru–0.1Ir; other examples are certainly possible. In one specific embodiment, the particulate component includes a ruthenium based material that includes ruthenium from about 85 wt % to about 99.9 wt %, inclusive, and rhodium from about 0.1 wt % to about 15 wt %.

In another embodiment of the particulate component, the particulate component includes a ruthenium based material with ruthenium from about 35 wt % to about 99.9 wt %, inclusive, a first precious metal from about 0.1 wt % to about 49.9 wt %, inclusive, and a second precious metal from about 0.1 wt % to about 49.9 wt %, inclusive, where the ruthenium is the single largest constituent of the particulate material. Ruthenium based materials that include rhodium and platinum, where the combined amount of rhodium and platinum is between 1%-65%, inclusive, may be particularly useful for certain spark plug applications. Examples of suitable particulate material compositions that fall within this exemplary category include those compositions having ruthenium plus two or more precious metals selected from the group of rhodium, platinum, palladium, iridium, and/or gold, such as Ru—Rh—Pt; Ru—Rh—Pd; Ru—Rh—Ir; Ru—Rh—Au; Ru—Pt—Rh; Ru—Pt—Pd; Ru—Pt—Ir; Ru—Pt—Au; Ru—Pd—Rh; Ru—Pd—Pt; Ru—Pd—Ir; Ru—Pd—Au; Ru—Ir—Rh; Ru—Ir—Pt; Ru—Ir—Pd; Ru—Ir—Au; Ru—Au—Rh; Ru—Au—Pt; Ru—Au—Pd; Ru—Au—Ir; Ru—Rh—Pt—Ir; Ru—Rh—Pt—Pd; Ru—Rh—Pt—Au; Ru—Pt—Rh—Ir; Ru—Pt—Rh—Pd; Ru—Pt—Rh—Au; etc. Such compositions may include the following non-limiting examples: Ru–30Rh–30Pt; Ru–35Rh–25Pt; Ru–35Pt–25Rh; Ru–25Rh–25Pt; Ru–30Rh–20Pt; Ru–30Pt–20Rh; Ru–20Rh–20Pt; Ru–25Rh–15Pt; Ru–25Pt–15Rh; Ru–15Rh–15Pt; Ru–20Rh–10Pt; Ru–20Pt–10Rh; Ru–10Rh–10Pt; Ru–15Rh–5Pt; Ru–15Pt–5Rh; Ru–5Rh–5Pt; Ru–10Rh–1Pt; Ru–10Pt–1Rh; Ru–2Rh–2Pt; Ru–1Rh–1Pt; Ru–30Rh–20Ir; Ru–30Pt–20Ir; Ru–30Ir–20Rh; Ru–30Ir–20Pt; Ru–40Rh–10Pt; Ru–40Rh–10Ir; Ru–40Pt–10Rh; Ru–40Pt–10Ir; Ru–40Ir–10Rh; and Ru–40Ir–10Pt; other examples are certainly possible.

According to another embodiment of the particulate component, the particulate component includes a ruthenium based material that includes ruthenium from about 35 wt % to about 99.9 wt %, inclusive, one or more precious metals from about 0.1 wt % to about 49.9 wt %, inclusive, and a refractory metal from about 0.1 wt % to about 5 wt %, inclusive, where the ruthenium is the single largest constituent of the alloy material. Tungsten, rhenium, tantalum, molybdenum, and/or niobium, for example, may be a suitable refractory metal for the particulate material. In one embodiment, a refractory metal constitutes the greatest constituent in the particulate component after ruthenium and one or more precious metals, and is present in an amount that is greater than or equal to 0.1 wt % and is less than or equal to 5 wt %. Examples of suitable particulate material compositions that fall within this embodiment include Ru—Rh—W; Ru—Rh—Mo; Ru—Rh—Nb; Ru—Rh—Ta; Ru—Rh—Re; Ru—Pt—W; Ru—Pt—Mo; Ru—Pt—Nb; Ru—Pt—Ta; Ru—Pt—Re; Ru—Rh—Pt—W; Ru—Rh—Pt—Mo; Ru—Rh—Pt—Nb; Ru—Rh—Pt—Ta; Ru—Rh—Pt—Re; Ru—Pt—Rh—W; Ru—Pt—Rh—Mo; Ru—Pt—Rh—Nb; Ru—Pt—Rh—Ta; Ru—Pt—Rh—Re; etc. Numerous compositional combinations of this embodiment are possible. Moreover, nickel and/or a rare earth metal may be used in addition to or in lieu of the exemplary refractory metals listed above. Examples of a particulate material composition including nickel include Ru—Rh—Ni; Ru—Pt—Ni; Ru—Rh—Pt—Ni; Ru—Pt—Rh—Ni; etc.

Depending on the particular properties that are desired, the amount of ruthenium in the ruthenium based material of the particulate component may be: greater than or equal to 35 wt %, 50 wt %, 65 wt %, or 80 wt %; less than or equal to 99.9%, 95 wt %, 90 wt %, or 85 wt %; or between 35-99.9%, 50-99.9 wt %, 65-99.9 wt %, or 80-99.9 wt %, to cite a few examples. Likewise, the amount of rhodium and/or platinum in the ruthenium based material of the particulate component may be: greater than or equal to 0.1 wt %, 2 wt %, 10 wt %, or 20 wt %; less than or equal to 49.9 wt %, 40 wt %, 20 wt %, or 10 wt %; or between 0.1-49.9 wt %, 0.1-40 wt %, 0.1-20 wt %, or 0.1-10 wt %. The amount of rhodium and platinum combined or together in the ruthenium based material of the particulate component may be: greater than or equal to 1 wt %, 5 wt %, 10 wt %, or 20 wt %; less than or equal to 65 wt %, 50 wt %, 35 wt %, or 20 wt %; or between 1-65 wt %, 1-50 wt %, 1-35 wt %, or 1-20 wt %. The amount of a refractory metal (i.e., a refractory metal other than ruthenium) in the ruthenium based material of the particulate component may be: equal to 0.1 wt %, 1 wt %, 2 wt %, or 5 wt %; less than or equal to 5 wt %; or between 0.1-5 wt %. The same exemplary percentage ranges apply to nickel. The amount of a rare earth metal in the ruthenium based material of the particulate component may be: greater than or equal to 0.01 wt % or 0.05 wt %; less than or equal to 0.1 wt % or 0.08 wt %; or between 0.01-0.1 wt %. The preceding amounts, percentages, limits, ranges, etc. are only provided as examples of some of the different material compositions that are possible, and are not meant to limit the scope of the alloy material, the particulate component, and/or the matrix component.

Still, in some embodiments the inner core 72 can be made of a ruthenium based alloy including from about 50 wt % to 98 wt % of ruthenium; at least one alloying element from about 2 wt % to 50 wt % selected from the group rhodium, iridium, palladium, gold, and platinum; and at least one doping element from about 10 ppm to 0.5 wt % selected from the group aluminum (Al), titanium (Ti), zirconium, vanadium (V), niobium, scandium, yttrium, hafnium, lanthanum, and actinium (Ac). Elements of the doping-element-group are constituted as such when provided from about 10 ppm to 0.5 wt %. It has been found that the doping element, if used, can combine with harmful elements such as carbon (C), nitrogen (N), phosphorus (P), sulfur (S), oxygen (O), or a combination thereof, which can aggregate on grain boundaries and in some cases cause brittleness to the ruthenium based alloy. Accordingly, the doping element can improve the ductility of the ruthenium based alloy which can be desired and useful for the formation and fabrication processes. Some non-limiting examples of potential compositions for the ruthenium based alloy in these embodiments include (given in weight percentage): Ru–55Rh; Ru–50Rh; Ru–45Rh; Ru–40Rh; Ru–35Rh; Ru–30Rh; Ru–25Rh; Ru–20Rh; Ru–15Rh; Ru–10Rh; Ru–5Rh; Ru–2Rh; Ru–55Pt; Ru–50Pt; Ru–45Pt; Ru–40Pt; Ru–35Pt; Ru–30Pt; Ru–25Pt; Ru–20Pt; Ru–15Pt; Ru–10Pt; Ru–5Pt; Ru–2Pt; Ru–30Pt–30Rh; Ru–25Pt–25Rh; Ru–20Pt–20Rh; Ru–15Pt–15Rh; Ru–10Pt–10Rh; Ru–5Pt–5Rh; and Ru–2Pt–2Rh. Furthermore, the ruthenium based alloy in these embodiments can include the following alloy systems: Ru—Rh—Ir; Ru—Rh—Pd; Ru—Rh—Au; Ru—Pt—Ir; Ru—Pt—Pd; Ru—Pt—Au; Ru—Rh—Pt—Ir; Ru—Rh—Pt—Pd; and Ru—Rh—Pt—Au.

As noted above, the outer skin 74 is made of a material that exhibits suitable ductility for formation and fabrication, including platinum and alloys of platinum, gold and alloys of gold, silver and alloys of silver, and nickel and alloys of nickel. Non-limiting examples of alloy systems for the outer skin 74 include Pt—Ni, Pt—W, Pt—Pd, Pt—Ir, and Pt—Ru. Alloy systems containing platinum, in particular, can provide suitable oxidation and corrosion resistance for engine and sparking applications while also providing suitable ductility; of course, the other alloys mentioned could also provide suitable oxidation and corrosion resistance. When suitable oxidation and corrosion resistance is provided for the outer skin 74, the outer skin need not be removed from the spark plug electrode 70 like some previously-known outer materials, and instead the outer skin remains and can be used as sparking surfaces for engine and sparking applications.

One specific example of a combined inner core 72 and outer skin 74, though certainly not limiting, is an inner core of Ru–(0.1–5)Rh–(0.1–2)(Re+W) wt % and an outer skin of Pt–10Ni. Of course, other example combinations are possible.

The spark plug electrode 70 can be manufactured in various ways. The exact manufacturing process used for the spark plug electrode 70 and its components—the inner core 72 and the outer skin 74—may depend in part upon the materials selected for the components and the final shape desired for the spark plug electrode. In one embodiment, the alloy material of the inner core 72 is made by a powder metallurgical process. One example powder metallurgical process includes the steps of: providing each of the constituent materials in powder form where they each have a certain powder or particle size; blending the powders together to form a powder mixture; and sintering the powder mixture to form the alloy material. In other examples, more or less steps could be provided, or different steps could be provided.

In a first step, the constituents of the inner core material are provided in powder form and have a particular powder or particle size that may depend on a number of factors including the materials selected. According to an embodiment, if selected, the particle size of ruthenium, rhodium, platinum, and rhenium when in a powder form can range approximately between 0.1 μm to 200 μm. In one embodiment of a ruthenium based alloy, the ruthenium and one or more precious metals can be pre-alloyed and formed into a base alloy powder first and before being mixed with rhenium. Some particular examples of pre-alloyed compositions include, but are not limited to Ru–2Rh; Ru–5Rh; Ru–10Rh; Ru–20Rh; Ru–10Pt–10Rh; pure Ir; Ir+2Rh; Ir+5Rh; and Ir+10Rh.

In a second step, the powders of the inner core material are blended or mixed together so that a powder mixture is produced. The blending step may be performed with or without the addition of heat.

A third step is sintering. This step may be performed in different ways depending in part upon, among other factors, the inner core materials being sintered. For instance, the resultant powder mixture may be sintered in a vacuum or in some type of protected environment at a sintering temperature of about 0.5-0.8 $T_{melt}$ of the base alloy. In other words, the temperature used to perform the sintering can be set to approximately 50-80% of the melting temperature of the base alloy, which in the cases of ruthenium alloys and pre-alloyed base alloys can be approximately between 1,350° C.-1,600° C.; other sintering temperatures are possible. The sintering step can also include application of pressure to the resultant powder mixture in order to introduce some type of porosity control to the alloy material. The exact amount of pressure applied may depend on the precise composition of the resultant powder mixture and the desired end attributes of the finished alloy material.

In another step of manufacturing the spark plug electrode 70, the outer skin 74 can be extruded or otherwise metalworked into a tube-like or hollow cylindrical structure and piece. Depending on the materials selected, extrusion of the outer skin 74 need not necessarily be performed at increased temperatures. The sintered inner core 72 can then be inserted by force or stuffed into the outer skin 74 piece via a suitable metalworking process to form an unfinished two-piece assembly part. For this, the sintered inner core 72 can have a solid cylindrical shape that is received in the hollow space defined by the outer skin 74 piece; other shapes and structures are possible for the core and skin. The two-piece assembly of the inner core and outer skin is then hot formed or worked into an elongated wire at an increased and elevated temperature in a further step of manufacturing the spark plug electrode 70. The phrase hot formed/forming, as used herein, refers to a simultaneous elongation of both the inner core and outer skin portions of the two-piece assembly at increased temperatures well above room temperatures such as the temperatures provided below. Example hot forming processes include hot extrusion processes, hot swaging processes, hot rolling processes, and hot drawing processes. The increased temperature under which the hot forming process takes place can depend upon the materials used for the inner core 72 and the outer skin 74, and in some cases the temperature can be selected to enable and facilitate formation and fabrication of the inner core into the final shape desired for the spark plug electrode 70. In one non-limiting example, the increased temperature can be approximately 1,000° C. or greater, can range approximately between approximately 1,000° C. and 1,500° C., or can range approximately between approximately 1,000° C. and 1,300° C. In one example, the temperature of the two-piece assembly is increased as an integral step in the hot forming process; that is to say that increasing the temperature and forming are not necessarily separate and distinct steps. In another example, however, the temperature of the two-piece assembly is increased in a separate and distinct step and immediately before the forming step. In either case the combined materials of the two-piece assembly are deformed simultaneously at the increased temperature.

In one specific example, with the inner core 72 of Ru–5Rh–1Re and the outer skin 74 of pure Pt, a hot swaging process can be performed at a temperature range of approximately 1,100 to 1,400° C. The process can consist of multiple passes or steps for a gradual diameter reduction at each pass. In this example, a diameter reducing rate of the two-piece assembly can range between approximately 8 to 18% from the initial overall diameter to the subsequently reduced overall diameter. During the hot swaging process, atomic diffusion takes place adjacent a surface-to-surface interface between the inner core 72 and outer skin 74 to produce an Pt—Ru alloy layer (interface alloying layer) on the interface. After the hot swaging process, therefore, an effective metallurgical bonding occurs and exists between the inner core 72 and outer skin 74 at the interface. This diffusion and resulting metallurgical bond will also occur and exist in the other hot forming processes.

In the above-described embodiments of the spark plug electrode 70, the ruthenium and iridium based alloy materials of the inner core 72 are suitably formed and fabricated into the final shape desired at increased temperatures. Cold metalworking temperatures, such as room temperatures, in contrast have in some cases been found unsuitable for the shapes and material properties desired, and sometimes required by the application, for the spark plug electrode 70. One shortcoming of the ruthenium and iridium based alloys that can prevent cold metalworking is their relatively low ductility. Accordingly, the ruthenium and iridium based alloys of the inner core 72 are formed at increased temperatures for the embodiments described herein. Some drawbacks of forming ruthenium and iridium based alloys at increased temperatures is that they can experience excessive oxidation which causes weight loss and can lead to breaking and fracture. This can be particularly problematic for the relatively small dimensions desired of the final shape of the spark plug electrode 70—for example, a final diameter of approximately 0.7 mm—because the relatively small dimensions are more susceptible and prone to the drawbacks and the resulting performance deterioration. The outer skin 74 is therefore used to protect the inner core 72 and insulate it during the hot forming process at increased temperatures and helps prevent excessive oxidation and breakage and fracture.

Figure 7B:
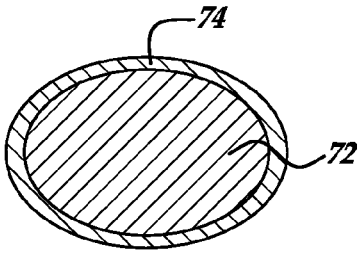
Figure 7C:
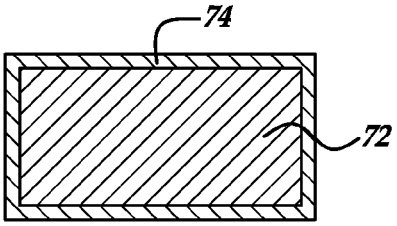
Figure 7D:
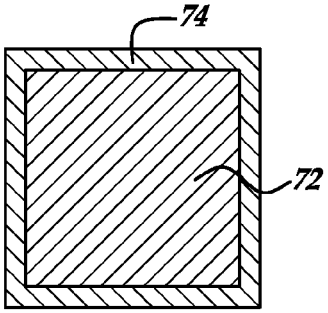
Figure 7E:
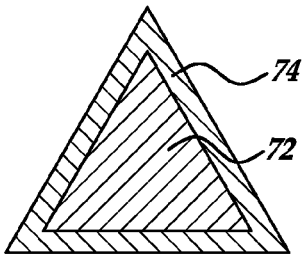
Figure 7F:
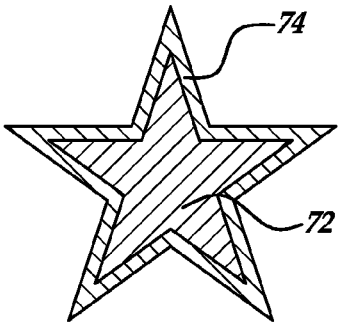

Referring to FIG. 6, after hot forming, the outer skin 74 can have a thickness T ranging approximately between 1 μm to 200 μm or ranging approximately between 10 μm to 50 μm, and the overall diameter D of the outer skin and inner core 72 can range approximately between 0.2 mm to 2 mm, or 0.7 mm; other dimensions are possible. Referring to FIGS. 7*a*-7*f*, the elongated wire of the co-extruded outer skin 74 and inner core 72 can have different sectional profiles: a circular profile as shown in FIG. 7*a*, an oval profile as shown in FIG. 7*b*, a square profile as shown in FIG. 7*c*, a rectangular profile as shown in FIG. 7*d*, a triangular profile as shown in FIG. 7*e*, and a star profile as shown in FIG. 7*f*. The elongated wire can then be cut or otherwise cross-sectioned into individual spark plug electrodes 70 which are subsequently attached and used in the spark plug 10.

The grain sizes referenced in this description can be determined by using a suitable measurement method, such as the Planimetric method outlined in ASTM E112.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A method of making a spark plug electrode, comprising the steps of:

a. providing an inner core of a ruthenium (Ru) based alloy or an iridium (Ir) based alloy;

b. providing an outer skin over at least a portion of said inner core to produce a core and skin assembly, said outer skin having platinum (Pt), gold (Au), silver (Ag), or nickel (Ni), or having an alloy of Pt, an alloy of Au, an alloy of Ag, or an alloy of Ni;

c. after said outer skin has been provided over said at least a portion of said inner core, increasing the temperature of said core and skin assembly to a temperature greater than 1,000° C.; and d. hot forming said core and skin assembly at the increased temperature into an elongated wire, wherein both of said inner core and said outer skin are elongated during the hot forming process.

2. The method set forth in claim 1, wherein, after hot forming said core and skin assembly, said outer skin has a thickness ranging between approximately 1 μm to 200 μm, inclusive.

3. The method set forth in claim 1, wherein step (c) includes increasing the temperature of said core and skin assembly to a temperature greater than 1,000° C. but less than approximately 1,500° C.

4. The method set forth in claim 3, wherein step (c) includes increasing the temperature of said core and skin assembly to a temperature greater than 1,000° C. but less than approximately 1,300° C.

5. The method set forth in claim 1, wherein step (d) includes hot forming said core and skin assembly at the increased temperature into said elongated wire having a generally circular cross-section.

6. The method set forth in claim 5, wherein step (d) includes hot forming said core and skin assembly at the increased temperature into said elongated wire having an overall diameter (D) ranging between approximately 0.2 mm to 2.0 mm, inclusive.

7. The method set forth in claim 6, wherein step (d) includes hot forming said core and skin assembly at the increased temperature into said elongated wire having an overall diameter (D) of approximately 0.7 mm.

8. The method set forth in claim 1, wherein step (d) includes hot forming said core and skin assembly at the increased temperature into said elongated wire via a co-extrusion process at the increased temperature.

9. The method set forth in claim 1, further comprising the step of cutting said elongated wire into a plurality of spark plug electrodes.

10. The method set forth in claim 1, wherein said inner core is a Ru based alloy comprising rhodium (Rh), rhenium (Re), and tungsten (W).

11. The method set forth in claim 10, wherein said outer skin is an alloy of Pt comprising Ni.

12. The method set forth in claim 1, wherein step (a) includes providing said inner core via a powder metallurgical process.

13. The method set forth in claim 12, further comprising the step of providing said outer skin via an extrusion process to produce a hollow piece, and wherein step (b) includes providing said outer skin over said at least portion of said inner core via inserting said inner core into said hollow piece to produce said core and skin assembly.

14. The method set forth in claim 1, wherein, during the performance of step (d), an alloying layer is produced adjacent an interface between said inner core and said outer skin via diffusion, and, after the performance of step (d), a metallurgical bond exists between said inner core and said outer skin.

15. A spark plug comprising at least one spark plug electrode made by the method of claim 1.

16. A method of making a spark plug, comprising the steps of:

a. providing a center electrode, an insulator at least partly surrounding said center electrode, a shell at least partly surrounding said insulator, and a ground electrode attached to said shell;

b. providing an inner core via a powder metallurgical process to produce a solid piece, said inner core being of a ruthenium (Ru) based alloy or an iridium (Ir) based alloy;

c. providing an outer skin via an extrusion process to produce a hollow piece, said outer skin having platinum (Pt), gold (Au), silver (Ag), or nickel (Ni), or having an alloy of Pt, an alloy of Au, an alloy of Ag, or an alloy of Ni, wherein said solid piece of said inner core is formed separately from said hollow piece of said outer skin;

d. inserting said solid piece of said inner core into said hollow piece of said outer skin to produce a core and skin assembly;

e. increasing the temperature of said core and skin assembly;

f. hot forming said core and skin assembly at the increased temperature into an elongated wire, wherein both of said inner core and said outer skin are elongated during the hot forming process;

g. cutting said elongated wire into at least one spark plug electrode; and h. attaching said spark plug electrode to said center electrode or to said ground electrode, or attaching a first spark plug electrode to said center electrode and a second spark plug electrode to said ground electrode.

17. The method set forth in claim 16, wherein step (e) includes increasing the temperature of said core and skin assembly to a temperature greater than approximately 1,000° C. but less than approximately 1,500° C.

18. The method set forth in claim 17, wherein step (f) includes hot forming said core and skin assembly at the increased temperature into an elongated wire having an overall diameter (D) ranging between approximately 0.2 mm to 2.0 mm, inclusive.

19. The method set forth in claim 18, wherein step (f) is performed without said inner core of said core and skin assembly substantially experiencing oxidation and breakage and fracture.

20. The method set forth in claim 19, wherein, during the performance of step (f), an alloying layer is produced adjacent an interface between said inner core and said outer skin via diffusion, and, after the performance of step (f), a metallurgical bond exists between said inner core and said outer skin.

* * * * *